US008891795B2

(12) United States Patent
Andersson

(10) Patent No.: US 8,891,795 B2
(45) Date of Patent: Nov. 18, 2014

(54) TRANSCUTANEOUS BONE CONDUCTION DEVICE VIBRATOR HAVING MOVABLE MAGNETIC MASS

(75) Inventor: Marcus Andersson, Gothenburg (SE)

(73) Assignee: Cochlear Limited, Macquarie University, NSW (AU)

( * ) Notice: Subject to any disclaimer, the term of this patent is extended or adjusted under 35 U.S.C. 154(b) by 0 days.

(21) Appl. No.: 13/362,645

(22) Filed: Jan. 31, 2012

(65) Prior Publication Data

US 2013/0195304 A1 Aug. 1, 2013

(51) Int. Cl.
*H04R 25/00* (2006.01)

(52) U.S. Cl.
CPC ..... *H04R 25/652* (2013.01); *H04R 25/606* (2013.01)
USPC ..... 381/326; 381/151; 381/380

(58) Field of Classification Search
USPC ..... 381/151, 326, 380
See application file for complete search history.

(56) References Cited

U.S. PATENT DOCUMENTS

| | | | | |
|---|---|---|---|---|
| 4,498,461 | A | 2/1985 | Hakansson | |
| 4,612,915 | A | 9/1986 | Hough et al. | |
| 4,726,378 | A * | 2/1988 | Kaplan | 607/115 |
| 6,643,378 | B2 | 11/2003 | Schumaier | |
| 7,198,596 | B2 | 4/2007 | Westerkull | |
| 7,266,208 | B2 * | 9/2007 | Charvin et al. | 381/328 |
| 8,005,247 | B2 | 8/2011 | Westerkull | |
| 2004/0032962 | A1 * | 2/2004 | Westerkull | 381/151 |
| 2004/0210103 | A1 | 10/2004 | Westerkull | |
| 2005/0249366 | A1 | 11/2005 | Westerkull | |
| 2006/0056649 | A1 | 3/2006 | Schumaier | |
| 2007/0053536 | A1 * | 3/2007 | Westerkull | 381/326 |
| 2009/0248155 | A1 | 10/2009 | Parker | |
| 2009/0252353 | A1 * | 10/2009 | Parker | 381/151 |
| 2010/0121134 | A1 | 5/2010 | Parker | |
| 2011/0268303 | A1 | 11/2011 | Ahsani | |

FOREIGN PATENT DOCUMENTS

| | | |
|---|---|---|
| DE | 19541882 | 5/1997 |
| DE | 10247969 | 5/2004 |
| DE | 202004006117 | 7/2004 |
| DE | 102006026288 | 1/2007 |
| JP | 2004-527165 | 9/2004 |
| WO | 01/93645 | 12/2001 |
| WO | 2004/093401 | 10/2004 |
| WO | 2005/000391 | 1/2005 |

OTHER PUBLICATIONS

Stefan Stenfelt et al., "Transmission properties of bone conducted sound: Measurements in cadaver heads", J. Accoust. Soc. Am. 118 (4), Oct. 2005, pp. 2873-2391 (19 pages).
Hakkansson et al., "Hearing Thresholds With Direct Bone Conduction Versus Conventional Bone Conduction", Scand Audiol 13: 3-13, 1984 (11 pages).
International Search Report and Written Opinion for International Application No. PCT/IB2013/050839 mailed Jul. 15, 2013 (14 pages).

* cited by examiner

*Primary Examiner* — Curtis Kuntz
*Assistant Examiner* — Ryan Robinson
(74) *Attorney, Agent, or Firm* — K&L Gates LLP

(57) ABSTRACT

A passive transcutaneous bone conduction device configured to deliver externally-generated mechanical vibrations to a bone of a recipient's head, the device comprising: an implantable magnetic coupler configured to be rigidly attached to the bone; and an external vibrator including an actuator having a movable magnetic mass; wherein the movable magnetic mass and the magnetic coupler form a transcutaneous magnetic coupling sufficient to retain the vibrator against soft tissue covering the bone with sufficient force to facilitate delivery of mechanical vibrations from the vibrator to the bone.

21 Claims, 10 Drawing Sheets

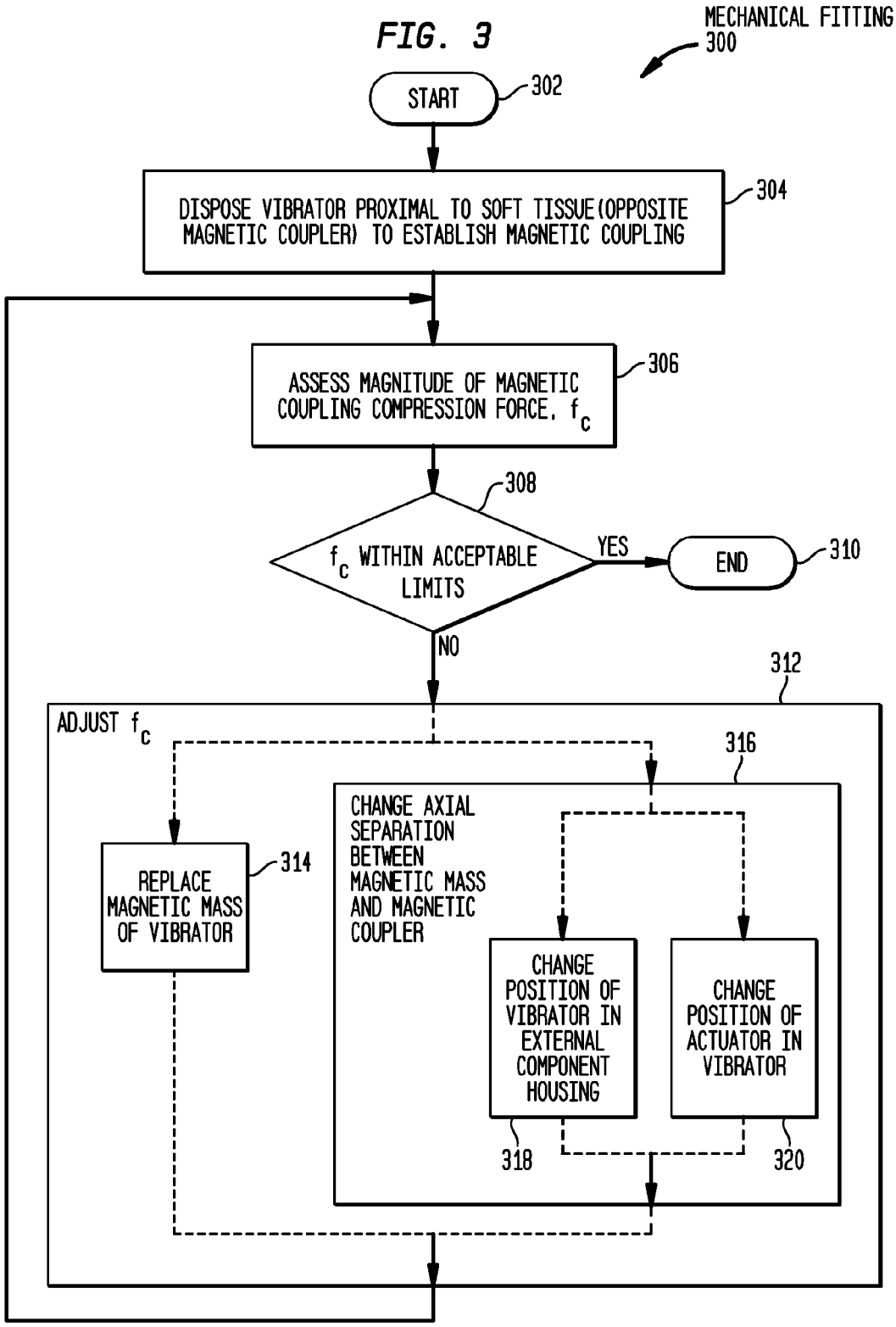
FIG. 3
MECHANICAL FITTING
300
START
302
DISPOSE VIBRATOR PROXIMAL TO SOFT TISSUE(OPPOSITE MAGNETIC COUPLER) TO ESTABLISH MAGNETIC COUPLING
304
ASSESS MAGNITUDE OF MAGNETIC COUPLING COMPRESSION FORCE, $f_c$
306
308
$f_c$ WITHIN ACCEPTABLE LIMITS
YES
END
310
NO
312
ADJUST $f_c$
316
REPLACE MAGNETIC MASS OF VIBRATOR
314
CHANGE AXIAL SEPARATION BETWEEN MAGNETIC MASS AND MAGNETIC COUPLER
CHANGE POSITION OF VIBRATOR IN EXTERNAL COMPONENT HOUSING
CHANGE POSITION OF ACTUATOR IN VIBRATOR
318
320

TRANSCUTANEOUS BONE CONDUCTION DEVICE VIBRATOR HAVING MOVABLE MAGNETIC MASS

BACKGROUND

1. Field of the Invention

The present invention relates generally to transcutaneous bone conduction devices, and more particularly, to a transcutaneous bone conduction device vibrator having a movable magnetic mass.

2. Related Art

Hearing loss, which may be due to many different causes, is generally of two types: conductive and sensorineural. Sensorineural hearing loss is due to the absence or destruction of the hair cells in the cochlea which transduce sound signals into nerve impulses. Various hearing prostheses are commercially available to provide individuals suffering from sensorineural hearing loss with the ability to perceive sound. For example, cochlear implants include an electrode array for implantation in the cochlea to deliver electrical stimuli to the auditory nerve, thereby causing a hearing percept.

Conductive hearing loss occurs when the normal mechanical pathways which transfer acoustic energy from sound waves to fluid waves in the cochlea are impeded. For example, condsuctive hearing loss may caused by damage to the ossicular chain or ear canal. Individuals suffering from conductive hearing loss may retain residual hearing.

Individuals suffering from conductive hearing loss typically receive a hearing aid. Hearing aids deliver acoustic energy directly to the tympanic membrane, or eardrum. In particular, a conventional hearing aid amplifies received sound and delivers the amplified sound directly to the tympanic membrane via a component positioned in the ear canal or on the pinna. The acoustic energy of the amplified sound ultimately causes motion of the perilymph in the cochlea resulting in stimulation of the auditory nerve.

In contrast to hearing aids, certain types of hearing prostheses, commonly referred to as bone conduction devices, include an actuator that converts received sound into mechanical vibrations. The vibrations are transferred through the skull to the cochlea causing generation of nerve impulses resulting in a hearing perept representative of the received sound.

SUMMARY

In accordance with one aspect of the present invention, a passive transcutaneous bone conduction device configured to deliver externally-generated mechanical vibrations to a bone of a recipient's head is disclosed. The device comprises an implantable magnetic coupler configured to be rigidly secured to the bone; and an external vibrator including an actuator having a movable magnetic mass; wherein the movable magnetic mass and the magnetic coupler form a transcutaneous magnetic coupling sufficient to retain the vibrator against the recipient's head with sufficient force to facilitate delivery of mechanical vibrations from the vibrator to the bone.

In accordance with another aspect of the present invention, a method of evoking a hearing percept is disclosed. The method comprises generating a vibration indicative of a received sound by moving a magnetic mass; and transferring at least a portion of the generated vibration to a recipient via a transcutaneous magnetic coupling established by the magnetic mass and a magnetic component implanted in the recipient.

In accordance with another aspect of the present invention, a bone conduction device is disclosed. The bone conduction device comprises means for generating vibration in response to a received sound signal, wherein the means for generating vibration magnetically couples the means for generating vibration to a recipient of the bone conduction device.

In accordance with another aspect of the present invention, another method of evoking a hearing percept is disclosed. The method comprises generating a vibration with a magnetic mass of an electromagnetic actuator; and magnetically coupling the magnetic mass to a component implanted in the recipient.

BRIEF DESCRIPTION OF THE DRAWINGS

Aspects and embodiments of the present invention are described below with reference to the attached drawings, in which:

FIG. 3 is a flow diagram of a method, according to an embodiment of the present invention, of mechanically fitting a recipient with a bone conduction device of the present invention;

DETAILED DESCRIPTION

Aspects of the present invention are generally directed to a transcutaneous bone conduction device having an external vibrator that includes an actuator with a movable mass at least a portion of which is magnetized. The vibrator delivers externally-generated mechanical vibrations to a recipient's bone via a transcutaneous magnetic coupling between the vibrator magnetic mass and an implanted magnetic coupler integrated with an osseointegrated bone fixture. This advantageously eliminates the need to include an additional external magnet for such purposes, which was typically implemented in conventional bone conduction devices as an external pressure plate for contacting the recipient.

Specifically, the movable magnetic mass functions both as a seismic mass for the actuator and as the external transcutaneous coupling magnet. The weight of this movable magnetic mass is less than the sum of the weight of the two corresponding elements (discrete seismic mass and coupling magnet) if they were to be implemented separately, as in conventional devices. Because the noted design constraint has been eliminated, the pressure plate of conventional devices is not included in some embodiments of the present invention, enabling the vibrator of such embodiments to be located much closer to the recipient than vibrators of conventional bone conduction devices. In those embodiments which have an external pressure plate, the pressure plate need nnto and through ear canal 106. Disposed across the distal of be magnetic. As such, the mass and dimensions of the pressure plate are less than the mass and dimensions of pressure plates of traditional transcutaneous bone conduction devices. Thus, in these embodiments the operational location of the vibrator is closer to the recipient as compared to traditional devices.

Figure 1:
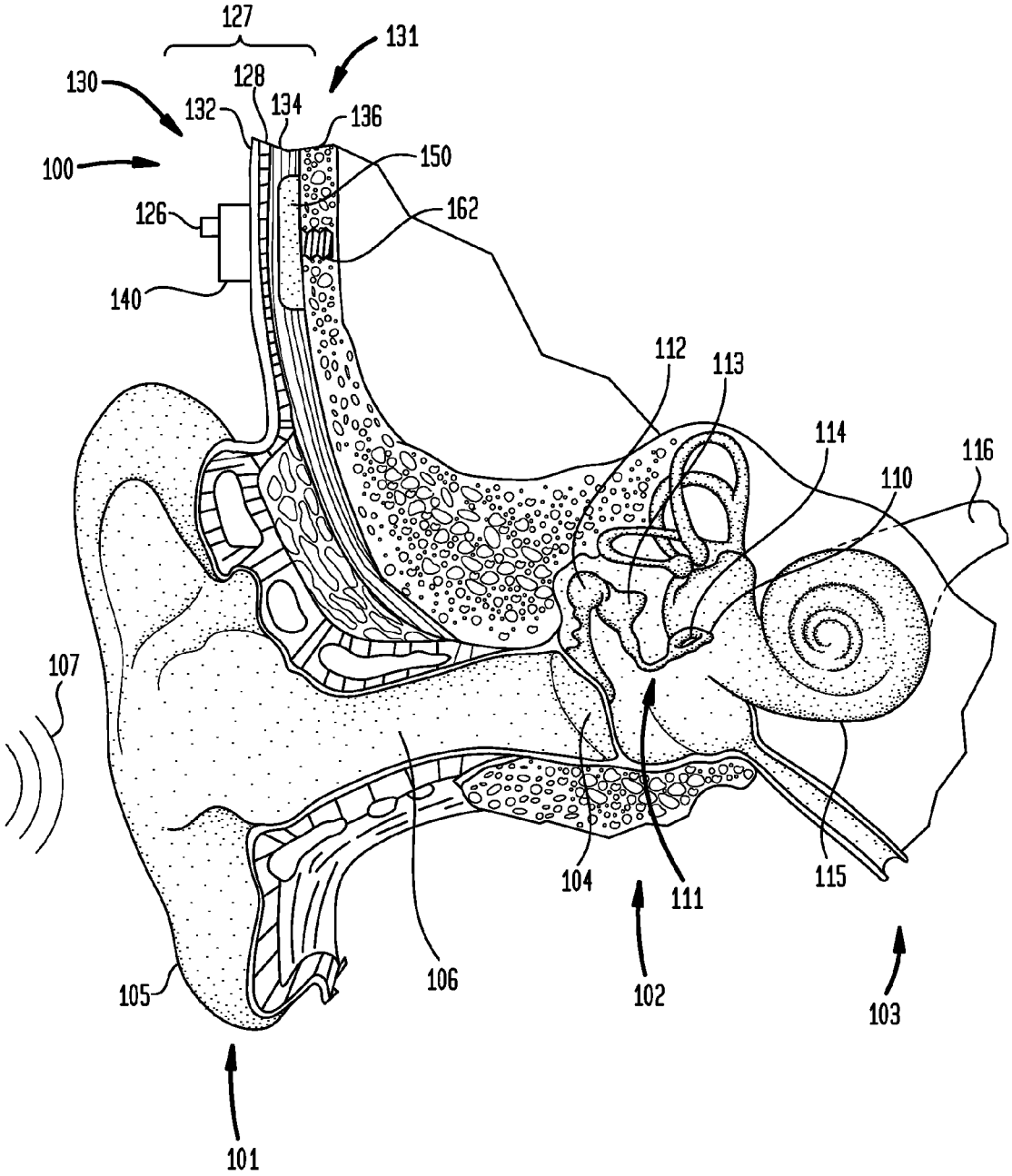
FIG. 1 is a perspective view of a transcutaneous bone conduction device in which embodiments of the present invention may be implemented.

FIG. 1 is a perspective view of a transcutaneous bone conduction device 100 in which embodiments of the present invention may be implemented. Elements of recipient's ear are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled end of ear canal 106 is a tympanic membrane 104 which vibrates in response to acoustic wave 107. This vibration is coupled to an oval window or fenestra ovalis 110 through three bones of a middle ear 102, collectively referred to as the ossicles 111 and comprising the malleus 112, the incus 113 and the stapes 114. The ossicles 111 of middle ear 102 serve to filter and amplify acoustic wave 107, causing oval window 110 to vibrate. Such vibration sets up waves of fluid motion within cochlea 115. Such fluid motion, in turn, activates hair cells (not shown) that line the inside of cochlea 115. Activation of the hair cells causes appropriate nerve impulses to be transferred through the spiral ganglion cells and auditory nerve 116 to the brain (not shown), where they are perceived as sound, i.e., a hearing percept is caused.

FIG. 1 also illustrates the positioning of bone conduction device 100 relative to outer ear 101, middle ear 102 and an inner ear 103 of a recipient of device 100. As shown, bone conduction device 100 is positioned behind outer ear 101 of the recipient. Bone conduction device 100 comprises external components 130 and internal components 131. External components 130 include a vibrator 140 and a sound input element 126 to receive sound signals. Sound input element 126 may comprise, for example, a microphone, telecoil, etc. As illustrated in FIG. 1, sound input element 126 is located on vibrator 140. Alternatively, sound input element 126 may be located in the housing of vobrator 140, or at a location separate from vibrator 140, e.g., positioned in the recipient's ear, etc.

In addition to vibrator 104, external components 130 comprise a sound processor and/or various other operational components not illustrated in FIG. 1. In operation, sound input device 126 converts received sound 107 into electrical audio signals. The audio signals are utilized by the sound processor to generate control signals that cause vibrator 140 to vibrate.

In accordance with embodiments of the present invention, a bone fixture 162 is used to rigidly attach a magnetic coupler 150 to the recipient's skull 136. Bone fixture 162 may be a bone screw configured to be iosseointegrated in skull 136. The arrangement by which magnetic coupler 150 is integrated with bone fixture 162 results in the coupler being positioned underneath soft tissue 127 that may include skin 132, adipose tissue 128 and muscle 134.

As will be described in more detail below, magnetic coupler 150 is made of a material that generates and/or is reactive to a magnetic field, or otherwise permits the establishment of an attractive magnetic force between the moving magnetic mass in the vibrator and magnetic coupler 150 sufficient to hold vibrator 140 against soft tissue 127 such that vibrations produced by vibrator 140 are transferred across soft tissue 127 to skull 136 via magnetic coupler 150 and bone fixture 162. These vibrations are transferred without physical penetration of the skin.

Figure 2A:
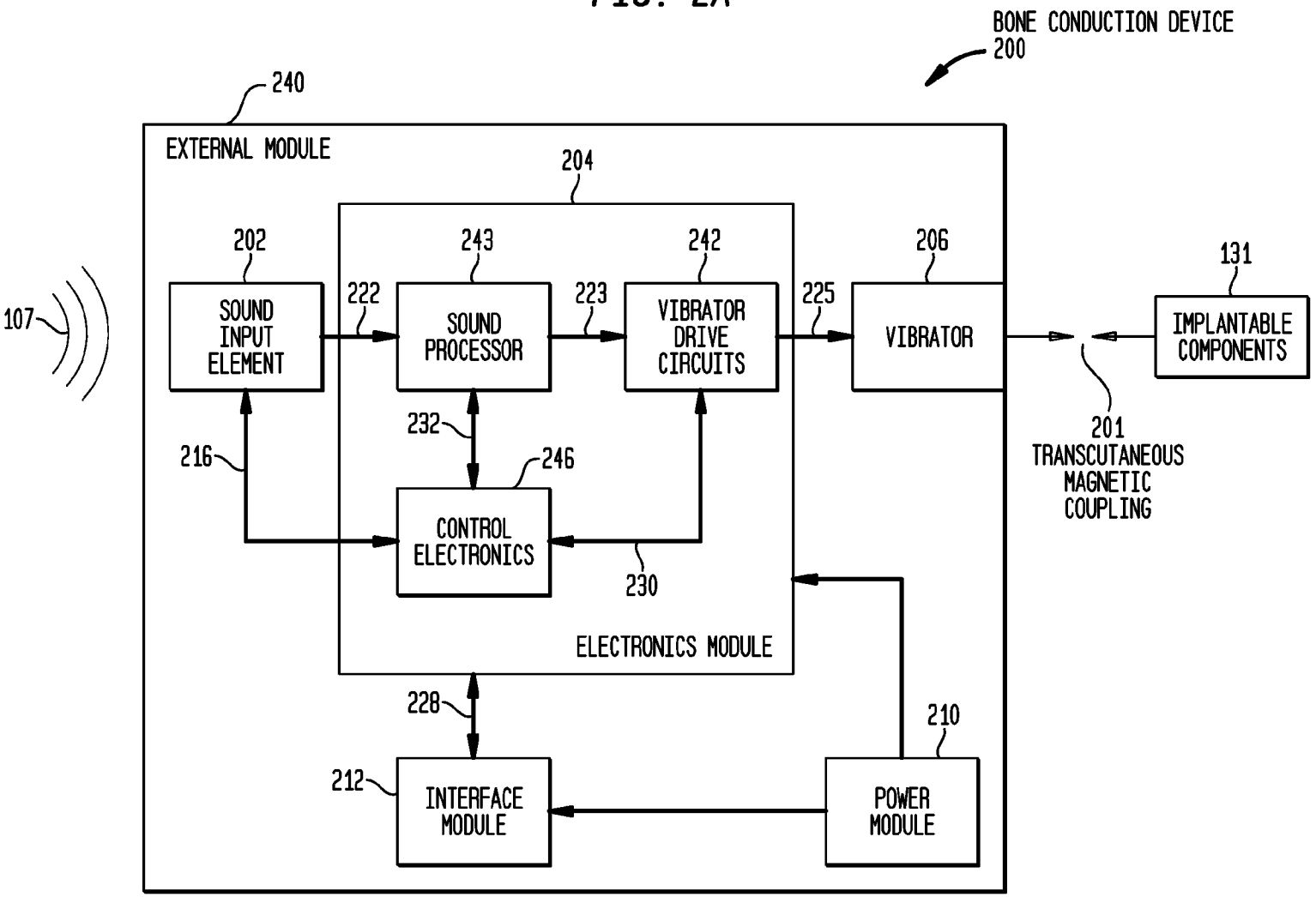
FIG. 2A is a functional block diagram of an embodiment of the transcutaneous bone conduction device illustrated in FIG. 1.

FIG. 2A is a functional block diagram of an examplary embodiment of bone conduction device 100, referred to herein as bone conduction device 200. In FIG. 2A, an electrical sound or audio signal 222 representative of received sound 107 is generated by sound input element 202. Sound input element 202 may be a microphone, a connector for connecting to an audio source, or sound input element 202 may be or contain a source of audio signals itself.

Audio signal 222 is provided to an electronics module 204 that utilizes electrical audio signal 222 to generate vibrator drive signal 225. As described in more detail below, in the embodiment illustrated in FIG. 2A, electronics module 204 includes a sound processor 243, control electronics 246, and vibrator drive circuits 242. Electronics module 204 also includes a variety of other elements known to those of ordinary skill in the art.

A vibrator 206 receives drive signal 225 and generates a reciprocating mechanical output force that is delivered to skull 136 (FIG. 1) of the recipient via transcutaneous magnetic coupling 201. Delivery of this output force causes a hearing percept, as is known in the art.

FIG. 2A also illustrates external module 240 as further including a power module 210 and an interface module 212. Power module 210 provides electrical power to one or more components of external component 240. For ease of illustration, power module 210 has been shown connected only to an interface module 212 and electronics module 204. However, it should be appreciated that power module 210 may be used to supply power to any electrically powered circuits/components of external module 240. Interface module 212 allows the recipient to interact with external module 240. For example, interface module 212 may allow the recipient to adjust the volume, alter the speech processing strategy, power on/off the device, etc. Interface module 212 communicates with electronics module 204 via signal line 228.

In some embodiments, sound input element 202, electronics module 204, vibrator 206, power module 210 and interface module 212 are all integrated in a single implantable housing. However, it should be appreciated that in certain embodiments of the present invention, the illustrated and other components may be housed in separate housings. Similarly, it should also be appreciated that in such embodiments, direct connections between the various modules and devices are not necessary and that the components may communicate, for example, via wireless connections.

In FIG. 2A, electrical audio signal 222 is output from sound input element 202 to sound processor 243. Sound processor 243 uses one or more of a plurality of techniques to selectively process, amplify and/or filter audio signal 222 to generate a processed audio signal 223. In certain embodiments, sound processor 243 may include substantially the same sound processor as is used in an air-conduction hearing aid.

Processed audio signal 223 is provided to vibrator drive circuits 242. Vibrator drive circuits 242 generate drive signals 225 to vibrator 206. Based on drive signal 225, vibrator 206 provides a vibrational mechanical output force to skull 136 of the recipient.

As illustrated, control electronics 246 may be connected to interface module 212, sound input element 202, sound processor 243 and/or vibrator drive circuits 242. In some embodiments, based on inputs received at interface module 212, control electronics 246 may provide instructions to, or request information from, other components of external module 240. In certain embodiments, in the absence of user inputs, control electronics 246 may control the operation of external module 240.

Figure 2B:
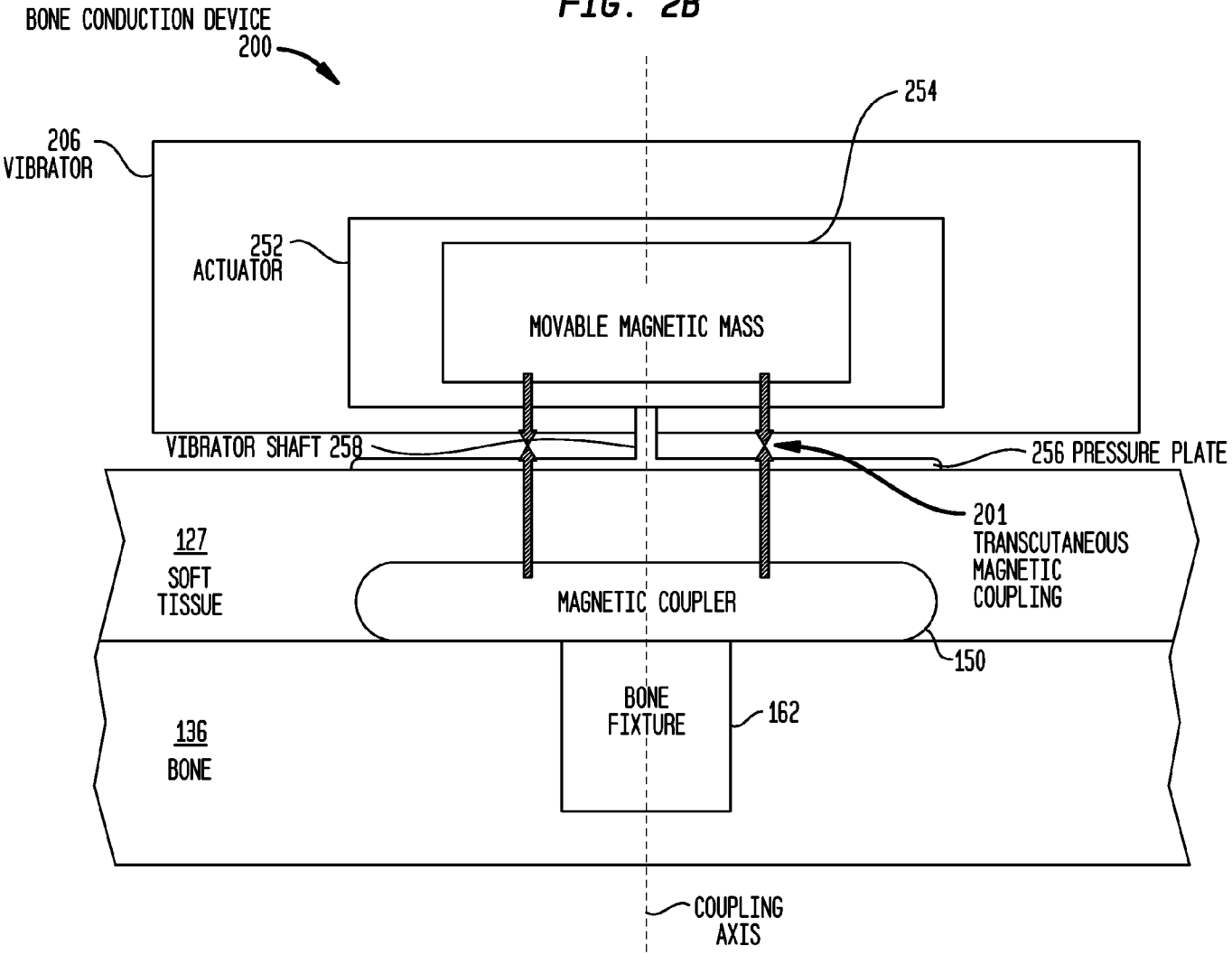
FIG. 2B is a simplified cross-sectional view of an embodiment of selected components of a transcutaneous bone conduction device, in accordance with embodiments of the present invention.

FIG. 2B is a simplified cross-sectional view of selected components of an embodiment of transcutaneous bone conduction device 200. A bone fixture 162 (FIG. 1) is osseointegrated into bone 136 (FIG. 1) and an integrated magnetic coupler 150 (FIG. 1) is disposed in/beneath soft tissue 127. External vibrator 206 includes an actuator 252 with a movable magnetic mass 254. Disposed between vibrator 206 and skull 136 is an optional pressure plate 256 connected to the vibrator via a vibrator shaft 258. Alternatively, pressure plate 256 is not included, and vibrator 206 abuts the recipient's skull.

A transcutaneous magnetic coupling 201 is formed by actuator magnetic mass 254 and magnetic coupler 150. Magnetic coupling 201 retains pressure plate 256 of vibrator 206 against the recipient's skull in alignment with bone fixture 162. In other words, movable magnetic mass 254 functions both as a seismic mass for actuator 252 and as an external magnet to form transcutaneous magnetic coupling 201.

Providing movable magnetized mass 254 in actuator 252 which serves as the external magnet which forms a transcutaneous magnetic coupling 201 advantageously eliminates the need to include an additional external magnet for such purposes. Traditionally, such an additional magnet was included in a pressure plate. With the elimination of the need for such a magnetic pressure plate, the pressure plate is optional and, when implemented, the mass and dimensions of the pressure plate may be minimal since it need not be magnetic. This enables the vibrator of such embodiments to be located much closer to the recipient than vibrators of traditional bone conduction devices.

FIG. 3 is a flow diagram illustrating a method 300, according to an embodiment of the present invention, of mechanically fitting a recipient with an embodiment of bone conduction device 100. For ease of illustration, FIG. 3 will be described with reference to bone conduction device 200. Fitting a bone conduction device for a recipient includes two aspects: a mechanical fitting phase and an operational fitting phase (the latter being a process of adjusting operational parameters of the bone conduction device to the particular hearing characteristics of the recipient). The mechanical fitting phase can be carried out by, for example., a surgeon at the time of implantation, or at a time subsequent to implantation, for example, by an audiologist. While it may be sufficient to perform the mechanical fitting phase only once, more typically there may arise a need to adjust the mechanical fit, i.e., to undergo one or more additional iterations of the mechanical fitting phase.

In mechanical fitting process 300, flow starts at block 302 and proceeds to block 304, where vibrator 206 of a bone conduction device 200 is placed against soft tissue 127 of a recipient at a location adjacent implanted magnetic coupler 150 to establish magnetic coupling 201.

At block 306, the magnitude of the compression force, $f_C$, generated by magnetic coupling 201, is assessed. As a practical matter, at least two competing factors contribute to the determination of an appropriate compression force, $f_C$: a need to ensure a reasonable likelihood that the external component will be held in place during normal operating conditions; and a need to maintain the compression force below a threshold beyond which the compression force may cause necrosis of the soft tissue. For example, one assessment technique is for the person performing the method (i.e., the fitter) to grasp the external component and attempt to break the magnetic coupling by pulling the external component away from the soft tissue, thereby assessing by feel (i.e., by tactile, non-quantitative estimation) the magnitude of the compression force $f_C$. In addition to the manual, non-quantitative technique, other assessment techniques are contemplated. Flow proceeds from block 306 to block 308.

If it is determined at block 308 that compression force $f_C$ is within an acceptable range, then flow proceeds to block 310 and ends. On the other hand, if compression force $f_C$ is outside the acceptable range, then flow proceeds to block 312, where the compression force $f_C$ is adjusted, that is, increased or decreased as needed to shift the magnitude of compression force $f_C$ into the acceptable range. There are multiple options for adjusting compression force $f_C$ including some which are illustrated as blocks in FIG. 3. To reflect their optional nature, phantom (dashed) connectors are illustrated as leading to/from the optional blocks. For example, flow can proceed through block 312 via optional block 314. At block 314, the movable magnetic mass 254 of vibrator 206 is replaced with a different movable magnetic mass 254 having different magnetic properties. Or, flow can proceed through block 312 via optional block 316.

At block 316, an axial separation between a quiescent location of magnetic mass 254 and magnetic coupler 150 is increased or decreased, thereby decreasing or increasing compression force $f_C$, respectively. There are multiple options for altering the axial separation some which are illustrated as optional blocks within block 316. Again, to reflect their optional nature, phantom (dashed) connectors are illustrated as leading to/from the optional blocks. Flow can proceed through block 316 via optional block 318, where a quiescent position of the vibrator within a housing of the external component is adjusted. Alternatively, flow can proceed through block 316 via optional block 320, where a quiescent position of the magnetic mass within the vibrator is modified. Flow proceeds (loops back) from block 312 to block 306.

It should be appreciated that in FIG. 3, blocks 314-316 are not mutually exclusive, nor are blocks 318-320. In other words, various combinations of blocks 314-320 can be performed concurrently. Also, flow through blocks 306-308 and 312 may be proceed iteratively, as needed.

Figure 4A:
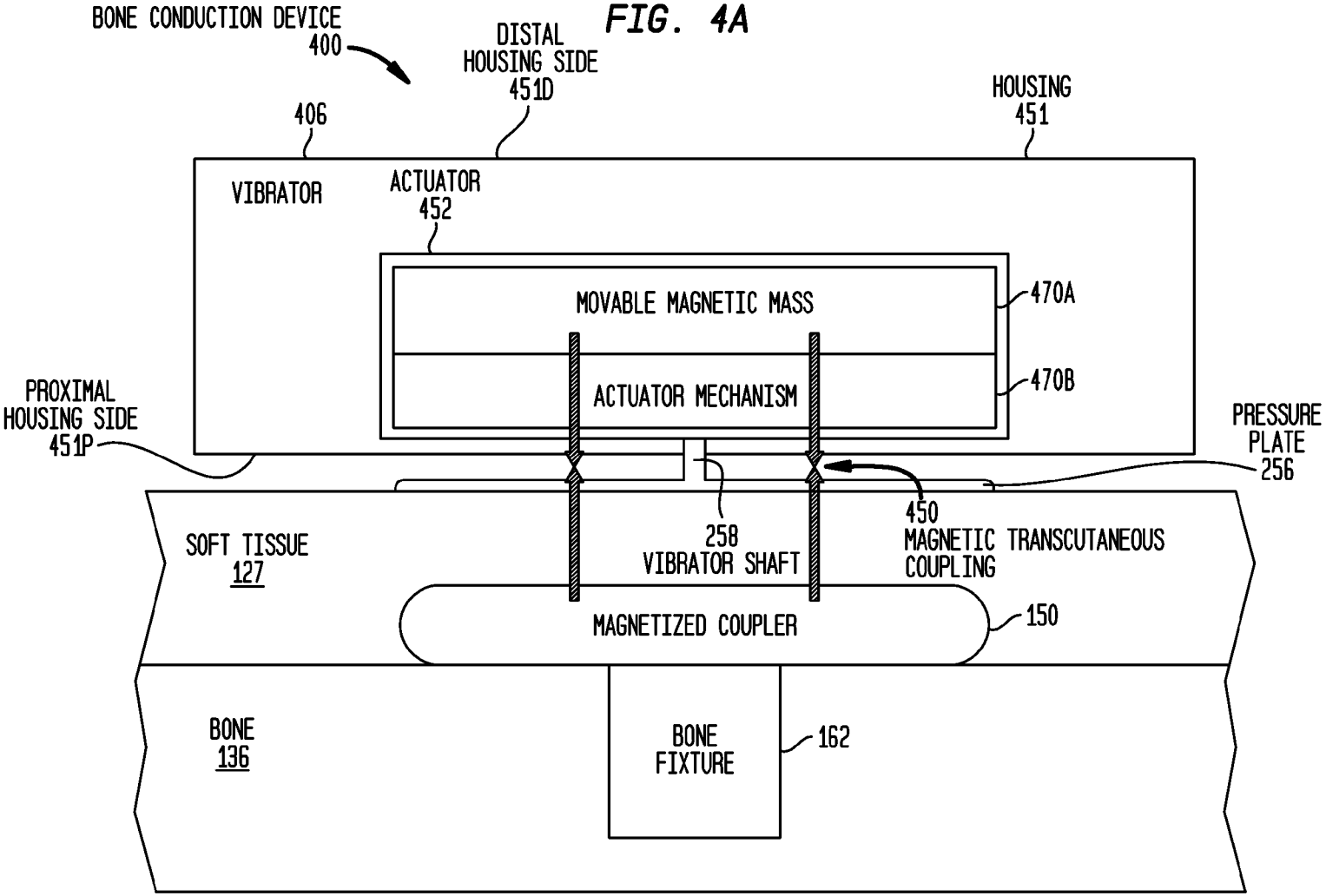
FIG. 4A is a simplified cross-sectional view of selected components of a transcutaneous bone conduction device, in which the actuator is configured such that the moving magnetic mass is furthest from the implanted magetized coupler.
Figure 4B:
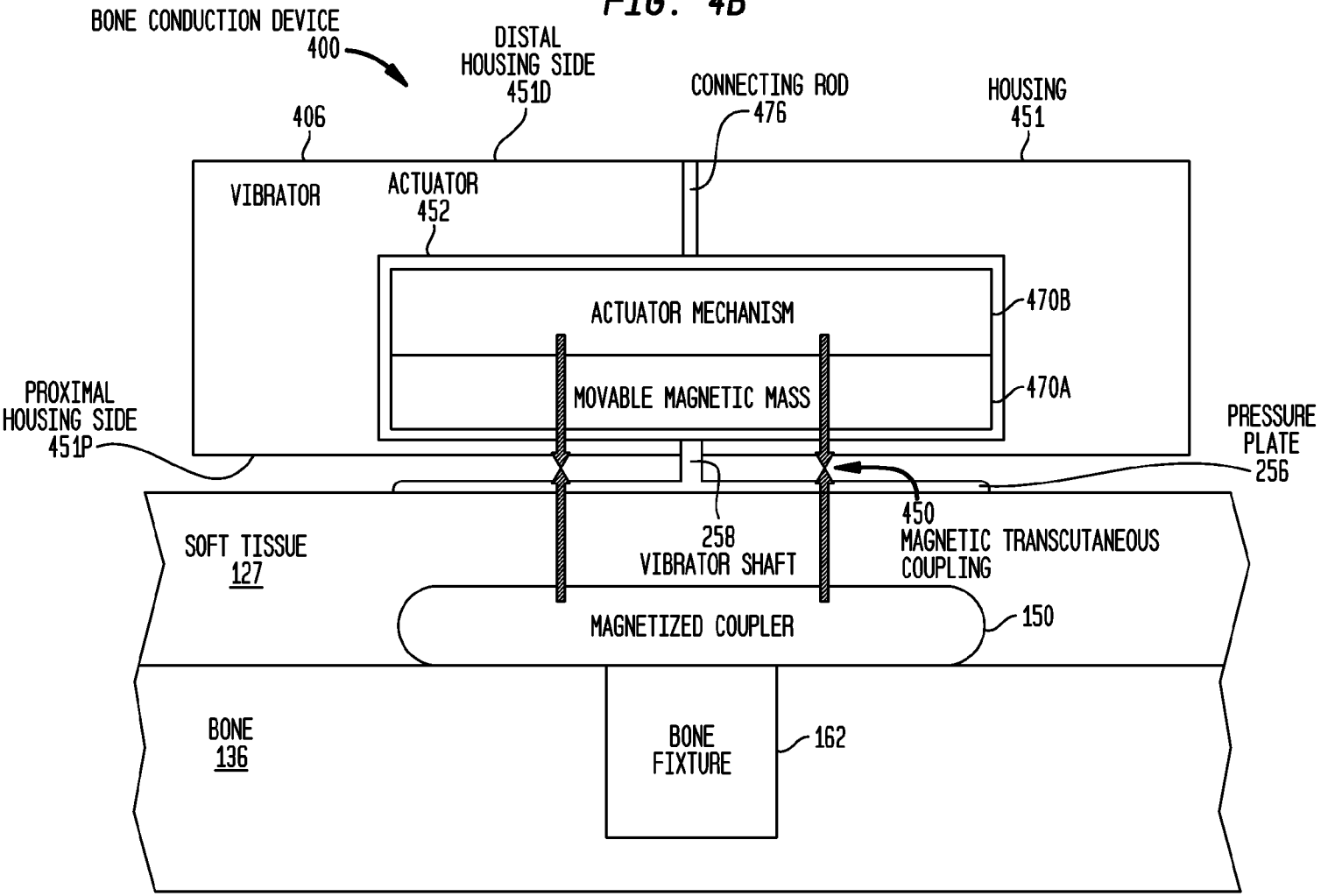
FIG. 4B is a simplified cross-sectional view of selected components of a transcutaneous bone conduction device, in which the actuator is configured such that the moving magnetic mass is closest to the implanted magetized coupler.

FIGS. 4A and 4B are simplified cross-sectional views of embodiments of bone conduction device 200, referred to herein as bone conduction device 400. Referring to FIG. 4A, transcutaneous bone conduction device 400 includes an implantable magnetized coupler 450 and bone fixture 162, as described above with reference to FIG. 2B. Coupler 450 is located within or under soft tissue 127 and is rigidly coupled to bone 136 via osseointegrated bone fixture 162.

The embodiment of vibrator 206 implemented in bone conduction device 400, referred to herein as vibrator 406, includes an actuator 452 and other components not shown. The components of vibrator 406 are disposed in a housing 451 that, when in its operational position on a recipient, has a proximal side 451P adjacent to and facing soft tissue 127, and a distal side 451D that faces away from soft tissue 127 when vibrator 406 is implemented in its operational position on the recipient.

As described above with reference to FIG. 2B, a pressure plate 256 is connected to actuator 452 via a vibrator shaft 258 such that the pressure plate extends from proximal side 451P of housing 451 to abut soft tissue 127 when vibrator 406 is in its operational position.

Actuator 452 comprises and a movable magnetic mass 454 mechanically coupled to to components of actuator 452 that interoperate with and move the mass. Such actuator components are collectively referred to herein as actuator mechanism 470B. In the embodiment illustrated in FIG. 4A, actuator 452 is configured such that actuator mechanism 470B is disposed between movable magnetic mass 454 and proximal side 451P of vibrator 406. In the embodiment illustrated in FIG. 4B, movable magnetic mass 454 is located relatively closer to magnetized coupler 450. A support structure 476 mechanically couples actuator 452 to the distal side 451D of vibrator housing 451. Actuator 452 is configured such that movable magnetic mass 454 is adjacent the proximate side 451P of the vibrator housing, controlled by actuator mechanism 470A located above the moving magnetic mass 470B.

Figure 5:
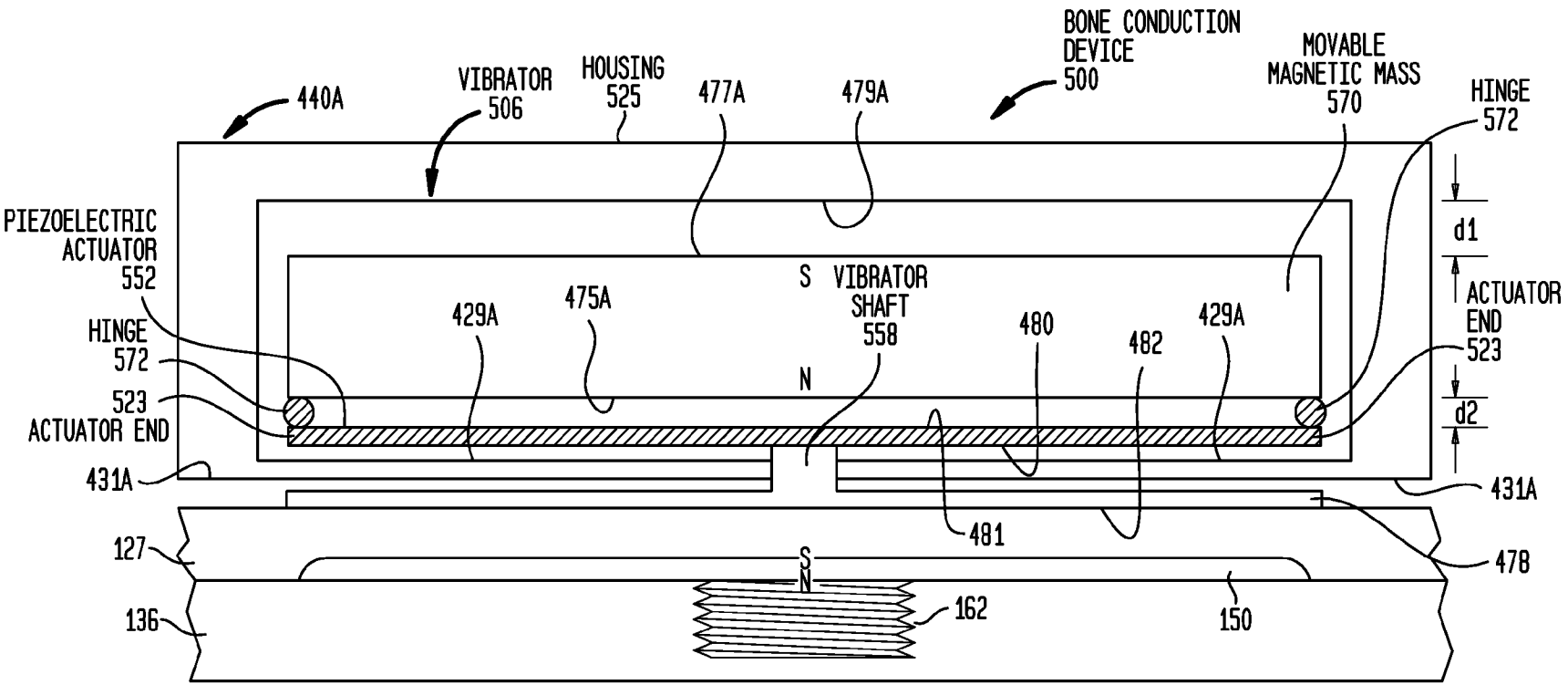
FIG. 5 is a simplified cross-sectional view of selected components of a transcutaneous bone conduction device having a piezoelectric actuator, in accordance with embodiments of the present invention.

Magnetic mass 454 and magnetic coupler 450 are configured to establish a transcutaneous magnetic coupling 401 that draws vibrator 406 against soft tissue 127 so as to facilitate efficient delivery to bone 136 of mechanical vibrations generated by actuator 452. For example, magnetic coupler 450 may be a permanent magnet, or alternatively, magnetic coupler 450 may be comprised of a ferromagnetic or paramagnetic material. Movable magnetic mass 454 may be entirely magnetic or may have portions that are magnetic. The magnetic properties and resulting magnetic strength of movable magnetic mass 454 and magnetized coupler 450 are selected to attain a coupling 401 having a desired configuration and strength. For ease of illustration magnetic coupling 451 is depicted by pairs of converging arrows regardless of the material properties and configuration of magnetic mass 454 and magnetic coupler 450. Actuator 452 in FIGS. 4A and 4B may be any actuator now or later developed. For example, FIG. 5 is a simplified cross-sectional view of an embodiment of bone conduction device 200, referred to herein as bone conduction device 500, in which actuator 452 is a piezoelectric actuator. Bone conduction device 500 includes a vibrator 506, among other components. Vibrator 506 includes a piezoelectric actuator 552 mounted via hinges 572 to a movable magnetic mass 570. Piezoelectric actuator 552 may be a piezoelectric of various known constructions. For simplicity, electrical connections by which the piezoelectric actuator can be energized are not illustrated in FIG. 5.

Ends 523 of piezoelectric actuator 552 are rotatably mounted via hinges 572 to magnetic mass 570. Piezoelectric actuator 552 is fixed to vibrator shaft 558 that extends through housing housing 425A of bone conduction device 500.

A second end of connector segment 476A can be fixed to pressure plate 478 that is, e.g., planar and that has an area of a surface 482 that is similar to if not substantially the same as an area of a surface 480 of piezoelectric actuator 474A. Connector segment 476A can also be fixed to a side 429A of housing 409A and/or a side 431A of housing 425A. If fixed to connector segment 476A, then side 429A of housing 409A can be formed of a resilient material, e.g., side 429A can be a spring. Likewise, if fixed to connector segment 476A, then side 431A of housing 425A can be formed of a resilient material, e.g., side 431A can be a spring.

Magnetic mass 570 and magnetic coupler 150 establish a transcutaneous magnetic coupling that draws vibrator 506 against soft tissue 127 so as to facilitate efficient delivery to bone 136 of mechanical vibrations generated by actuator 552. In operation, applying an electrical signal to the piezoelectric element causes the piezoelectric element to undergo a mechanical deformation. The mechanical coupling to piezoelectric actuator 474A via hinges 472A causes magnetic mass 470A to undergo acceleration due to the movement of piezoelectric actuator 474A. The mass/weight of magnetic mass 470A can be made significantly, if not substantially, larger than the mass/weight of piezoelectric actuator 474A. A benefit of such a mass/weight disparity is that the combined mass/weight which undergoes the acceleration can be increased significantly (if not substantially) without increasing the weight of the piezoelectric actuator 474A, thereby significantly (if not substantially) increasing the magnitude of the force generated by the acceleration. Via the mechanical coupling, output strokes (e.g., reciprocating motion) of actuator 474C subjects magnetic mass 470C to accelerations, which generates mechanical forces that are transferred to skull 136 by magnetic coupling 141, causing vibration of the perilymph, and thereby causing a perception of hearing by the recipient.

As pressure plate 478 can be made of a non-magnetic material, the mass/weight of pressure plate 478 can be further reduced. A further benefit is that an overall profile of external component 440A can be reduced in comparison to conventional bone conduction devices. This benefit can manifest as a reduced requirement for the strength of the magnetic coupling, thereby permitting the mass/weight of magnetic mass 470A to be reduced and/or reducing compression stress upon soft tissue 127.

Figure 6A:
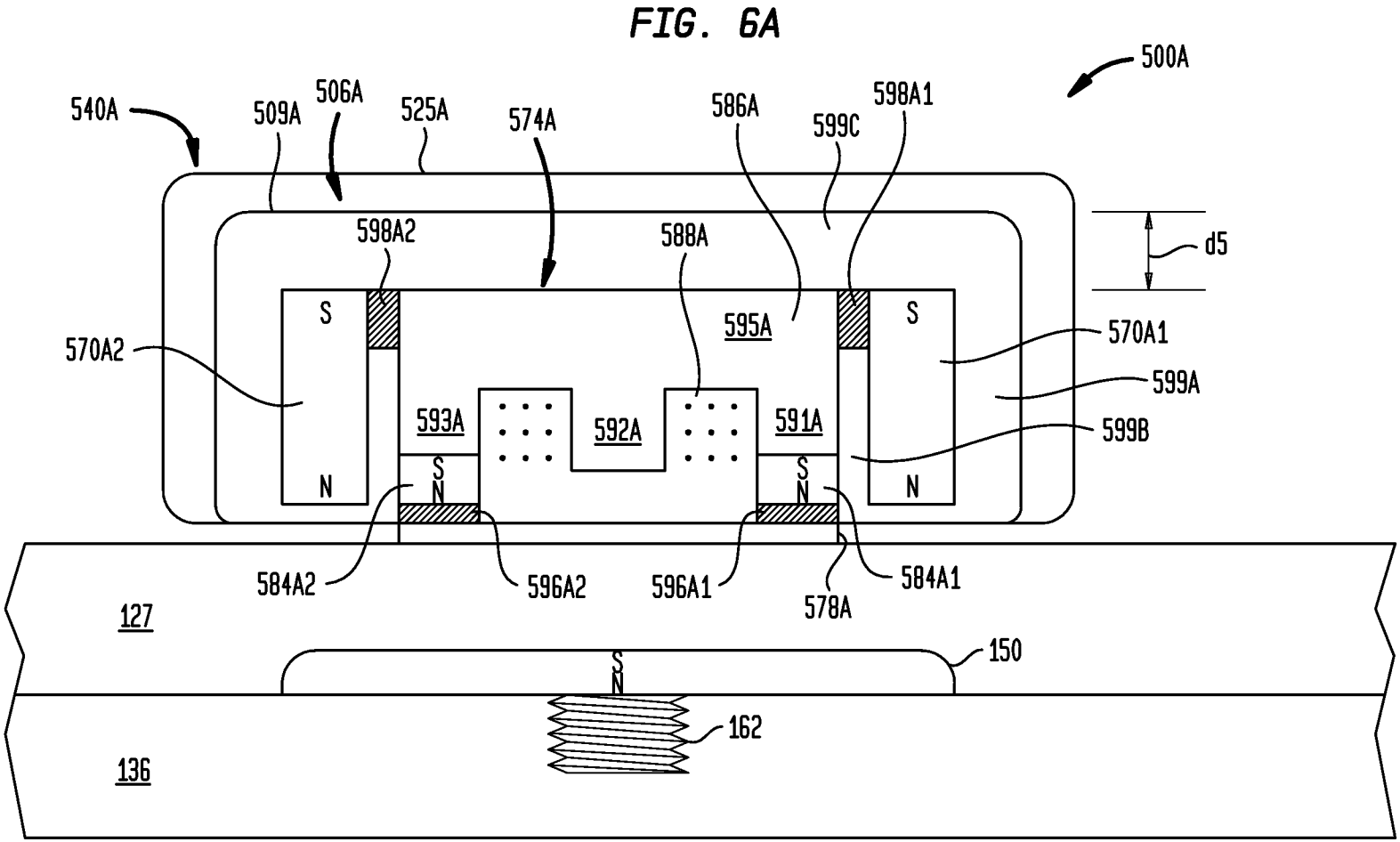
FIG. 6A is a cross-sectional view of an embodiment of the bone conduction device of the present invention.
Figure 6B:
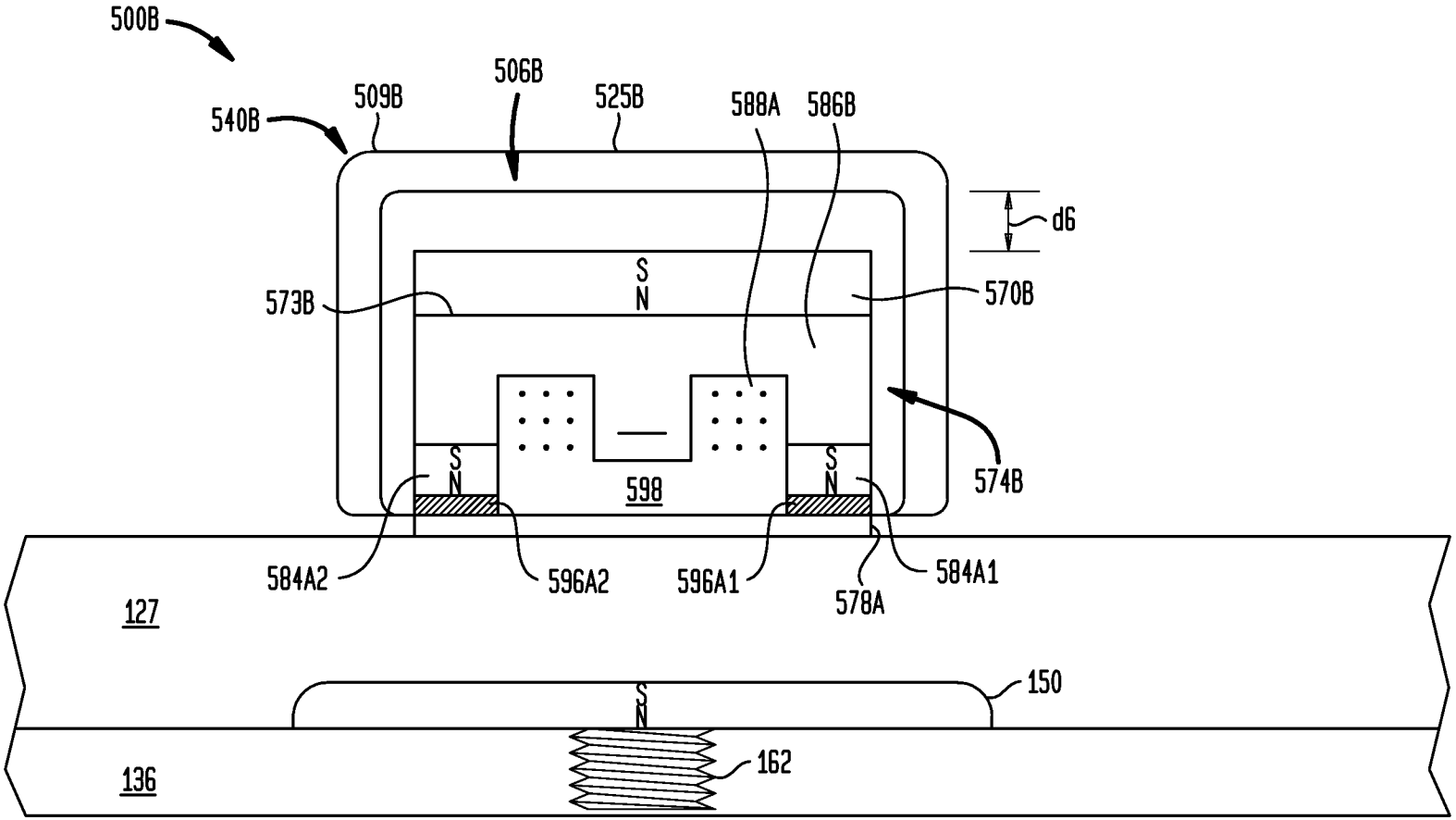
FIG. 6B is a cross-sectional view of an embodiment of the bone conduction device of the present invention.
Figure 6C:
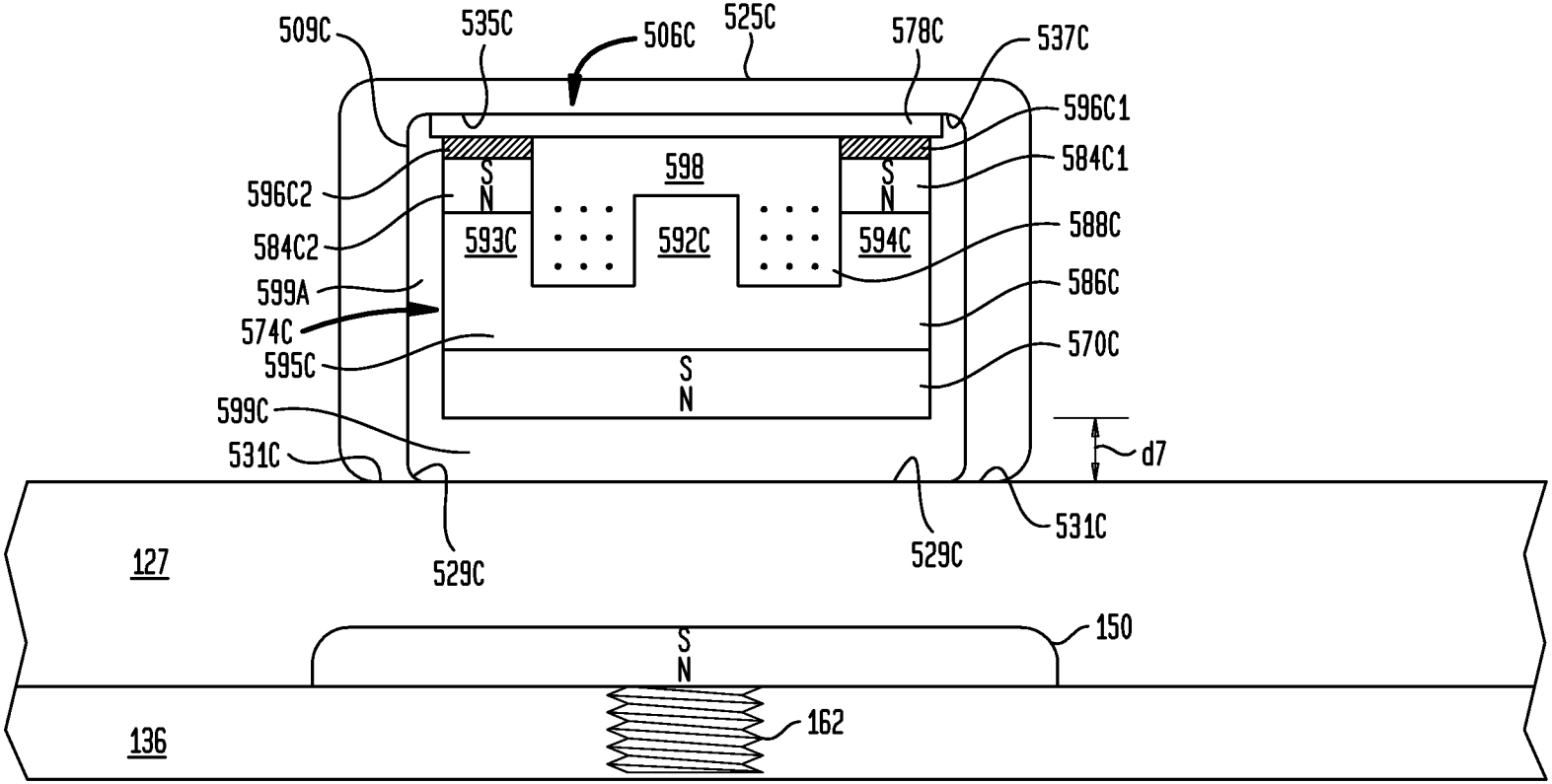
FIG. 6C is a cross-sectional view of an embodiment of the bone conduction device of the present invention.

It should be appreciated that in some embodiments, the movable magnetic mass may have a configuration other than rectangular, and may be implemented on more that one physical mass. Examples of such embodiments of the movable magnetic mass are shown in FIGS. 6A-6C in a vibrator having an electromechanical actuator. FIG. 6A is a cross-sectional view of an embodiment of an examplary 500A of bone conduction device 200 that includes an external component 540A. Bone conduction device 500A may include the same or similar components as bone conduction device 200. Relative to FIG. 2, FIG. 6A illustrates in more detail an example 506A of vibrator 206. For the sake of brevity, FIG. 6A does not illustrate the various other components of bone conduction device 500A that are included in a housing 525A.

Bone conduction device 500A is similar to bone conduction device 400 described above. In FIG. 6A, bone conduction device 500A includes vibrator 506A, among other components. Vibrator 506A includes an electromagnetic actuator 574A that converts energy into linear motion, e.g., a linear solenoid, in contrast to vibrator 406A of FIGS. 4A-4B which includes piezoelectric actuator 474A. Electromagnetic actuator 574A includes a bobbin 586A, an electrically conductive coil 588A wrapped around bobbin 586A (made of a ferroelectric material, e.g., iron), and magnets (e.g., permanent magnets) 584A1 and 584A2. For simplicity, electrical connections by which electromagnetic actuator 574A can be energized are not illustrated in FIG. 6A.

In cross-section, a peripheral surface of bobbin 586A resembles a letter "E". A long axis of a spine 595 of bobbin 586A is parallel to a long axis of magnetic coupler 150. Fingers 592A, 593A and 594A of bobbin 586 extend from spine 595A towards magnetic coupler 150 in a direction substantially perpendicular to the long axis of spine 595A. Magnets 584A1 and 584A2 are fixed to ends of fingers 594A and 593A, respectively.

Vibrator 506A includes movable magnetic masses 570A1 and 570A2, e.g., permanent magnets, first ends of which are fixed to opposing ends of spine 595A of bobbin 586A via connector segments 598A1 and 598A2, respectively. Long axes of magnetic masses 570A1 and 570A2 are oriented substantially perpendicular to the long axis of spine 595A.

First ends and second ends of magnetic masses 570A1 and 570A2 are disposed distal and proximal to magnetic coupler 150, respectively. In some respects, the disposition of magnetic masses 570A1 and 570A2 outward, relative to the long axis of spine 595A, presents a silhouette reminiscent of a two-basket/bag pannier for a bicycle or motorcycle; for ease of reference, the embodiment of FIG. 6A will be referred to hereinafter as a pannier-type configuration.

A pressure plate 578A that is, e.g., planar and that has a length along its long axis that is similar to if not substantially the same as a length of spine 595A, is disposed between vibrator 506A and soft tissue 127. End portions of pressure plate 578A are fixed to ends of fingers 594A and 593A of bobbin 586A via connector plates 596A1 and 596A2, respectively. Pressure plate 578A can be formed of a resilient material, e.g., it can be a spring. Connector plates 596A1 and 596A2 and pressure plate 578A can be described as a force-transfer assembly.

A first magnetic flux is generated from magnetic coupler 150. A second magnetic flux is generated from vibrator 506A and includes magnetic fluxes from magnetic masses 570A1 and 570A2. The second flux interacts with the first flux to magnetically (and transcutaneously) couple vibrator 506A to magnetic coupler 150. Fluxes from magnets 584A1 and 584A2 and from coil 588A (when energized) also comprise the second flux. Also, vibrator 506A may include components other than those depicted in FIG. 6A, some or all of which may generate respective magnetic fluxes that can comprise the second flux. In one example, fluxes other than those from magnetic masses 570A1 and 570A2 are arranged to provide no more than a minority, if not merely a negligible portion, of the second flux. In other words, at least a majority, if not all or substantially all, of the second flux is provided by magnetic masses 570A1 and 570A2. The fluxes from magnetic masses 570A1 and 570A2 interact with the first flux to magnetically (and transcutaneously) couple vibrator 506A to magnetic coupler 150. Via the magnetic coupling, delivery of mechanical vibrations from vibrator 506A to magnetic coupler 150, and therefore to skull 136, is facilitated. As magnetic masses 570A1 and 570A2 undergo acceleration due to motion of electromagnetic actuator 574A, a distance d5 will vary accordingly as magnetic mass 570C is moved.

In FIG. 6A, south (S) and north (N) poles of magnetic coupler 150 are illustrated as proximal and distal to pressure plate 578A, respectively. North (N) and south (S) poles of magnetic masses 570A1 and 570A2 are illustrated as proximal and distal to a long axis of pressure plate 578A, respectively. Also, north (N) and south (S) poles of magnets 584A1 and 584A2 are illustrated as proximal and distal to the long axis of pressure plate 578A, respectively. Other arrangements of the poles are contemplated.

FIG. 6B illustrates in cross-section, according to an embodiment of the present invention, an example 500B of bone conduction device 200 that includes an external component 540B. Bone conduction device 500B is similar to bone conduction device 500A. Like bone conduction device 500A, bone conduction device 500D can include the same or similar components as bone conduction device 200. Relative to FIG. 2, FIG. 6B illustrates in more detail an example 506B of vibrator 206. For the sake of brevity, FIG. 6B does not illustrate the various other components of bone conduction device 500B that are included in a housing 525B and that are the same or similar to components of bone conduction device 200. Also for the sake of brevity, minimal discussions of the similarities between bone conduction devices 500B and 500A will be provided. For simplicity, electrical connections by which coil 588A can be energized are not illustrated in FIG. 6B.

In contrast to the pannier-type configuration of magnetic masses 570A1 and 570A2 (relative to bobbin 586A in vibrator 506A) of FIG. 6A, vibrator 506B includes a magnetic mass 570B disposed against a surface 573B of a bobbin 586B. As arranged in FIG. 6A, bobbin 586B is disposed between magnetic mass 570B and magnetic coupler 150. Other arrangements are contemplated. Again, connector plates 596A1 and 596A2 and pressure plate 578A can be described as a force-transfer assembly. As magnetic mass 570B undergoes acceleration due to motion of electromagnetic actuator 574B, a distance d6 will vary accordingly as magnetic mass 570C is moved.

In FIG. 6B, south (S) and north (N) poles of magnetic coupler 150 are illustrated as proximal and distal to pressure plate 578A, respectively. North (N) and south (S) poles of magnetic mass 570B are illustrated as proximal and distal to pressure plate 78, respectively. Other arrangements of the poles are contemplated.

FIG. 6C illustrates in cross-section, according to an embodiment of the present invention, an example 500C of bone conduction device 200 that includes an external component 540C. Bone conduction device 500C is similar to bone conduction device 500B. Like bone conduction device 500B, bone conduction device 500C can include the same or similar components as bone conduction device 200. Relative to FIG. 2, FIG. 6C illustrates in more detail an example 506C of vibrator 206. For the sake of brevity, FIG. 6C does not illustrate the various other components of bone conduction device 500C that are included in a housing 525C and that are the same or similar to components of bone conduction device 200. Also for the sake of brevity, minimal discussions of the similarities between bone conduction devices 500C and 500B will be provided. For simplicity, electrical connections by which coil 588A can be energized are not illustrated in FIG. 6C.

In contrast to vibrator 506B of FIG. 6B, vibrator 506C of FIG. 6C is arranged so that a magnetic mass 570C (e.g., a permanent magnet) is disposed between bobbin 586C and magnetic coupler 150. As a result, and in further contrast to vibrator 506B, bobbin 586C is disposed between a force-distribution plate 578C and magnetic mass 570C. A side 535C of housing 509C can be disposed against and fixed to a force-distribution plate 578C, e.g., at ends of force-distribution plate 578C. Force-distribution plate 578C can be formed of a resilient material, e.g., it can be a spring. Connector plates 596C1 and 596C2 and force-distribution plate 578C can be described as a force-transfer assembly.

In further contrast to vibrator 506A, connector plates 596A1 and 596A2 mechanically couple fingers 594B and 593B of bobbin 586C to a force-distribution plate 578C, rather than to a skin-contacting plate such as skin-contacting plate 578A as in FIG. 6A. No skin-contacting plate per se is provided with vibrator 506C. Rather, a side 529C of housing 509C and/or a side 531*c* of housing 525C serves a substantially similar purpose for vibrator 506C as pressure plate 578A serves for vibrator 506A. Various configurations are contemplated. For example, both of sides 529C and 531C can be provided between soft tissue 127 and magnetic mass 570C such that side 531C covers side 529C and is interposed between side 529C and soft tissue 127. Alternatively, it could be that no side 529C is provided, rather only side 531C is provided, or vice-versa. Or, relative to a reference direction parallel to a long axis of magnetic mass 570C and an axis of symmetry extending through connector segment fixation system 162 perpendicular to the long axis of magnetic mass 570C, where the reference direction is radial to the axis of symmetry, side 531C can be provided in a peripheral region outside of housing 509C whereas side 529C is not provided in the peripheral region while side 531C is not provided in a central region inside of housing 509C whereas side 529C is provided in the central region. Depending upon the configuration, then side 529C of housing 509A and/or side 531C of housing 525C can be formed of a resilient material, e.g., side 529C and/or side 531C can be a spring. As magnetic mass 570C undergoes acceleration due to motion of electromagnetic actuator 574C, a distance d7 will vary accordingly as magnetic mass 570C is moved.

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A bone conduction device configured to deliver externally-generated mechanical vibrations to a bone of a recipient's head, the device comprising:

an implantable magnetic coupler configured to be rigidly secured to the bone; and an external vibrator including an actuator having a movable magnetic mass that acts as a seismic mass within the actuator;

wherein the movable magnetic mass and the magnetic coupler are configured to form a transcutaneous magnetic coupling sufficient to retain the vibrator against the recipient's head with sufficient force to facilitate delivery of mechanical vibrations from the vibrator to the bone, wherein the actuator is one of a piezoelectric transducer and an electromagnetic transducer.

2. The device of claim 1, further comprising:

a bone fixture configured to be osseointegrated in the bone, wherein the magnetic coupler is integrated with the bone fixture.

3. The device of claim 1, further comprising:

a pressure plate connected to the actuator and extending from a surface of the vibrator such that, when in its operational position, the pressure plate is disposed between the vibrator and the recipient.

4. The device of claim 1, wherein the magnetic coupler is a permanent magnet.

5. The device of claim 1, wherein the magnetic coupler includes at least one of a ferromagnetic, ferrimagnetic and a paramagnetic material.

6. The device of claim 3, wherein the pressure plate is non-magnetic.

7. The device of claim 1, wherein the actuator is configured such that non-magnetic components of the actuator are positioned in the vibrator to be more proximate to the recipient relative to the magnetic mass of the actuator when the device is in its operational position in a recipient.

8. The device of claim 1, wherein the actuator is configured such that non-magnetic components of the actuator are positioned in the vibrator to be more distal to the recipient relative to the magnetic mass of the actuator when the device is in its operational position in a recipient.

9. The device of claim 1, wherein:

the magnetic coupler is arranged as first and second discrete parts;

the magnetic mass is arranged as third and fourth discrete parts corresponding to the first and second parts, respectively;

the first and third parts establish a first transcutaneous magnetic coupling; and the second and fourth parts establish a second transcutaneous magnetic coupling.

10. The device of claim 1, wherein the magnetic mass is arranged as first and second discrete parts; and the first and second parts are disposed, in cross section, at opposing ends of a long axis of the actuator in a pannier-type configuration.

11. The device of claim 10, wherein long axes of the first and second parts of the magnetic mass are oriented perpendicularly to the long axis of the actuator.

12. A bone conduction device configured to deliver externally-generated mechanical vibrations to a bone of a recipient's head, the device comprising:

an implantable magnetic coupler configured to be rigidly secured to the bone; and an external vibrator including an actuator having a movable magnetic mass, wherein the actuator is configured such that non-magnetic components of the actuator are positioned in the vibrator to be more proximate to the recipient relative to the magnetic mass of the actuator when the device is in its operational position in a recipient, wherein the movable magnetic mass and the magnetic coupler are configured to form a transcutaneous magnetic coupling sufficient to retain the vibrator against the recipient's head with sufficient force to facilitate delivery of mechanical vibrations from the vibrator to the bone.

13. The device of claim 12, further comprising:

a bone fixture configured to osseointegrate in the bone, wherein the magnetic coupler is integrated with the bone fixture.

14. The device of claim 12, wherein the magnetic coupler includes at least one of a ferromagnetic, ferrimagnetic and a paramagnetic material.

15. The device of claim 12, wherein the actuator is configured such that non-magnetic components of the actuator are positioned in the vibrator to be more distal to the recipient relative to the magnetic mass of the actuator when the device is in its operational position in a recipient.

16. The device of claim 12, wherein:

the magnetic coupler is arranged as first and second discrete parts;

the magnetic mass is arranged as third and fourth discrete parts corresponding to the first and second parts, respectively;

the first and third parts establish a first transcutaneous magnetic coupling; and the second and fourth parts establish a second transcutaneous magnetic coupling.

17. The device of claim 12, wherein the magnetic mass is arranged as first and second discrete parts; and the first and second parts are disposed, in cross section, at opposing ends of a long axis of the actuator in a pannier-type configuration.

18. A bone conduction device configured to deliver externally-generated mechanical vibrations to a bone of a recipient's head, the device comprising:

an implantable magnetic coupler configured to be rigidly secured to the bone;

an external vibrator including an actuator having a movable magnetic mass that acts as a seismic mass within the actuator; and a pressure plate connected to the actuator and extending from a surface of the vibrator such that, when in its operational position, the pressure plate is disposed between the vibrator and the recipient, wherein the movable magnetic mass and the magnetic coupler are configured to form a transcutaneous magnetic coupling sufficient to retain the vibrator against the recipient's head with sufficient force to facilitate delivery of mechanical vibrations from the vibrator to the bone.

19. The device of claim 18, further comprising:

a bone fixture configured to be osseointegrated in the bone, wherein the magnetic coupler is integrated with the bone fixture.

20. The device of claim 18, wherein the magnetic coupler includes at least one of a ferromagnetic, ferrimagnetic and a paramagnetic material.

21. The device of claim 19, wherein the pressure plate is non-magnetic.

* * * * *